United States Patent [19]

Garnett

[11] Patent Number: 4,548,849

[45] Date of Patent: Oct. 22, 1985

[54] SEALING STRIPS OF ROWS OF POLYPROPYLENE FIBERS AND ROWS OF POLYTETRAFLUOROETHYLENE FIBERS

[75] Inventor: John F. C. Garnett, Ravensworth nr. Richmond, England

[73] Assignee: Linear Textiles Limited, Newton Aycliffe, England

[21] Appl. No.: 505,906

[22] Filed: Jun. 20, 1983

Related U.S. Application Data

[63] Continuation-in-part of Ser. No. 259,411, May 1, 1981, abandoned.

[30] Foreign Application Priority Data

May 2, 1980 [GB] United Kingdom ..... 8014612

[51] Int. Cl.[4] ..... D04H 11/00

[52] U.S. Cl. ..... 428/88; 156/72; 428/92; 428/95; 428/97

[58] Field of Search ..... 428/88, 92, 85, 95; 156/72; 429/97

[56] References Cited

U.S. PATENT DOCUMENTS 4,164,599 8/1979 Kessler ..... 428/92

FOREIGN PATENT DOCUMENTS 439367 5/1935 United Kingdom .
1000753 6/1962 United Kingdom .
1505310 12/1974 United Kingdom .
1541001 2/1979 United Kingdom .

*Primary Examiner*—Marion E. McCamish
*Attorney, Agent, or Firm*—Leydig, Voit & Mayer, Ltd.

[57] ABSTRACT

A sealing strip comprises a base and pile formed on the base. The strip is sandwiched between two surfaces to form a seal between the surfaces with the base being mounted on one surface and the pile being compressed by the other surface. If the seal is improved by increasing the compression, the friction between the pile and the other surface is such that the two surfaces cannot be readily moved relatively to one another in a direction parallel to the surfaces. The sealing strip endeavours to overcome this problem by having a yarn of a lower coefficient of friction than the fibres of the pile at or above the surface of the pile. This reduces the frictional force between the pile and the other surface thus allowing easy relative movement of the surfaces when the pile is highly compressed by the other surface to form an effective seal.

23 Claims, 4 Drawing Figures

SEALING STRIPS OF ROWS OF POLYPROPYLENE FIBERS AND ROWS OF POLYTETRAFLUOROETHYLENE FIBERS

This application is a continuation-in-part of U.S. patent application Ser. No. 259,411, filed May 1, 1981, now abandoned.

BACKGROUND TO THE INVENTION

1. Field of the Invention

The invention relates to sealing strips for forming a seal between two adjacent surfaces and to the manufacture of such sealing strips.

2. Discussion of the Prior Art

A previously proposed sealing strip comprises an elongate strip-like base for mounting on one of the surfaces and a pile extending from the base for contacting the other of said surfaces. The pile is formed by fibres which are all of one textile material. The material is commonly a polypropylene yarn. Such sealing strips, known in the art as pile weatherstripping, have been manufactured for many years and have found wide application for forming seals around sliding doors and windows.

The pile is of such a thickness that, in use, it is compressed between the two surfaces to form a seal between them and to allow relative movement of the two surfaces in a direction parallel to the two surfaces. For a particular pile, the effectiveness of the strip as a seal is determined by the degree of compression of the pile but the amount of compression is limited by the frictional forces generated by the compression. If the frictional forces are too great, they prevent easy relative movement of the surfaces.

SUMMARY OF THE INVENTION

According to the first aspect of the invention, there is provided a sealing strip for forming a seal between two adjacent surfaces which are relatively movable by manual operation and comprising an elongate strip-like base for attachment to one of said surfaces, a pile formed by fibres of a first yarn extending from the base to contact the other of said surfaces and a yarn which has a lower coefficient of friction than the first yarn and which is carried on the strip-like base with the pile of fibres to contact the other of said surfaces whereby when the sealing strip is compressed between said surfaces, the yarn of lower coefficient of friction reduces the frictional force tending to prevent relative movement between said pile and the surface contacted thereby in a direction parallel to the length of said base.

According to a second aspect of the invention, there is provided a sealing strip for providing an air barrier between two surfaces relatively movable by manual operation, the sealing strip comprising an elongate fabric base for attachment to one of said relatively movable surfaces, a first yarn applied to the fabric base by a tufting process to form yarn loops with the ends thereof remote from the fabric base contacting the other of said relatively movable surfaces, and a second yarn applied to the fabric base by a tufting process to form yarn loops located within the first yarn and contacting the other of said relatively movable surfaces, the second yarn having a lower coefficient of friction that the first yarn to reduce the frictional forces tending to prevent relative movement between the sealing strip and the other of said relatively movable surfaces.

According to a third aspect of the invention, there is provided a method of manufacturing a sealing strip according to the first aspect of the invention, comprising forming a pile of a first yarn on an elongate strip-like base for attachment to one of said surfaces and arranging a yarn of a lower coefficient of friction than the first yarn on the elongate strip-like base with a pile of fibres, whereby the lower coefficient of friction yarn and the pile of the first yarn contact and are compressed by the other of said surfaces to form a seal between the two surfaces and to reduce the frictional forces tending to prevent relative movement between the pile and the surface contacted thereby in a direction parallel to the length of the base.

According to a fourth aspect of the invention, there is provided a method of manufacturing a sealing strip according to the second aspect of the invention and comprising applying a first yarn to an elongate fabric base by a tufting process to form a first plurality of loops on said base, the first yarn loops contacting the other of said relatively movable surfaces for forming an air barrier in a direction transverse to the length of the elongate fabric base, applying a second yarn to said elongate fabric base by a tufting process to form a second plurality of loops on said base and contacting said other of said relatively movable surfaces, the second yarn having a lower coefficient of friction than said first yarn.

BRIEF DESCRIPTION OF THE DRAWINGS

The following is a more detailed description of two embodiments of the invention, by way of example, reference being made to the accompanying drawings, in which.

DESCRIPTION OF THE PREFERRED EMBODIMENTS

Figure 1:
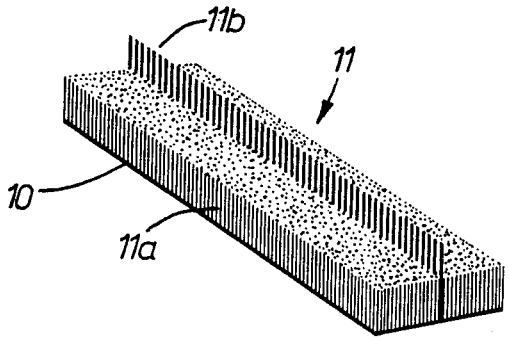
FIG. 1 is a perspective view of a first form of sealing strip.

Referring first to FIG. 1, the sealing strip comprises a base 10 of elongate strip-like form. The width of the strip may be from 3 to 20 millimeters and of any required length. A pile 11 is formed on the base 10 by fibre tufts of two types 11*a*, 11*b*. The first tufts 11*a* extend from the side edges to the centre of the base 10 and all the fibres have the same pile height which may, for example, be from 2 to 10 millimeters.

The second tufts 11*b* extend in a row along the centre of the base 10 and are of greater pile height than the first tufts. The yarn of these tufts 11*b* is such that they have a lower coefficient of friction than the yarn of the first tufts 11*a*. For example, the second tufts 11*b* may be made of polytetrafluoroethylene yarn and the first tufts of polypropylene yarn. The fibres may be of circular cross-section or may be of any other convenient cross-section.

Figure 2:
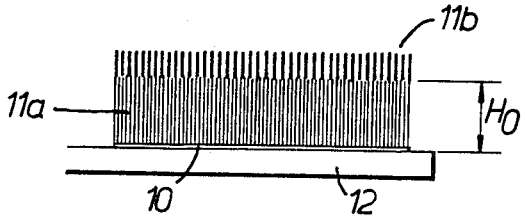
FIG. 2 is a side elevation of the strip of FIG. 1 attached to a surface.
Figure 3:
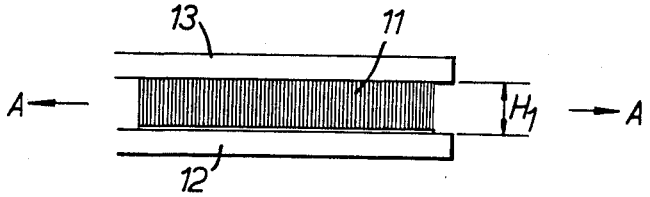
FIG. 3 is a side elevation of the strip of FIG. 1 forming a seal between two surfaces.

The sealing strip can be used to form a seal between two adjacent surfaces 12, 13 (FIGS. 2 and 3) which are relatively movable in a direction parallel to the surfaces. These surfaces may, for example, be a movable glass-carrying frame and a fixed frame of a sliding window or door. The strip is attached to one surface 12 (FIG. 2) by, for example, sliding the base 10 into a suitably dimensioned slot formed in the surface 12 and the gap between the two surfaces 12, 13 is such that the pile 11 is compressed when the surfaces are adjacent one another so that the pile height is reduced from $H_0$ (FIG. 2) to $H_1$ (FIG. 3). The pile 11 thus provides a seal against the ingress of air between the surfaces 12, 13 and also allows relative movement of the surfaces 12, 13 in the directions of the arrows A in FIG. 3, while preserving the seal. In addition, the pile 11 prevents the surfaces knocking together.

The amount by which the pile 11 is compressed determines the effectiveness of the seal: the greater the compression, the more effective the seal. However, increased compression increases the frictional forces between the pile and the surface 13, thus making the surfaces more difficult to move. This is important in sliding doors and windows, for example, which are opened manually since the frictional forces should not be sufficient to prevent this being readily accomplished.

The sealing strip described above with reference to the drawings can be highly compressed because the polytetrafluoroethylene fibres reduce the frictional forces between the two surfaces on relative movement therebetween, thus making them readily movable even with such high compressions. For example, the pile 11 may be compressed by 25% or more so that $H_1=0.75$ $H_0$. Such compression gives very low air flow rates between the surfaces even with high pressure differences across the pile 11.

It will be appreciated also that there are tolerances inherent in the construction of the sealing strip and these may be, in pile height, of the order of $0.1H_0$ or more. A similar tolerance may be inherent in the spacing between the surfaces 12, 13 and if these tolerances work culmatively a nominal compression lower than that which can be satisfactorily achieved with the sealing strip described above with reference to the drawings can be changed to an even lower compression, thus giving a very reduced, ineffective, seal, or can be so changed to a compression so great that the frictional forces are unacceptably high and make movement difficult. The compression achievable with the sealing strip described above with reference to the drawings, allows a useful seal to be provided even if compression is reduced and will not cause unacceptable friction even if the tolerances cause over-compression.

Since the spacings between surfaces on, for example, sliding windows and doors, are determined by the manufacturer of the windows and doors, the pile height for a particular gap can be determined from a required frictional force to achieve easy opening of the door or window. If the pile height is chosen just to achieve this required force, this will ensure that the maximum pile height is used which in turn gives maximum pile compression and optimum sealing characteristics.

The sealing strip may be manufactured as follows: the first tufts 11*a* may be formed by a weaving process using two sets of spaced weft yarns and passing respective warp yarns between the two sets of weft threads to form two spaced bases. File yarns are passed between the two sets of warp and weft yarns, looping around the warp and weft yarns. The pile yarns are then cut to produce two strips carrying a pile formed by the cut pile yarns: the weft threads forming the base 10. The base may be stiffened by a coating of a plastics material and/or may be attached to a backing such as a metal or plastics strip or a foamed plastics strip. Alternatively, the first tufts 11*a* may be formed by a tufting process in which loops of the material of the first tufts are formed on a base and the loops then cut to form a pile of fibres. It will be appreciated, however, that, as in the FIG. 4 embodiment, the loops need not be cut, so that the pile is formed by loops. This will have the advantage of reducing the frictional forces between the pile and a contacting surface because the loops, with their rounded ends, create lower frictional forces than cut yarn ends.

The second tufts 11*b* may be formed on a base carrying the first tufts 11*a* by a tufting process in which a row of loops of the yarn of lower coefficient of friction is formed along the length of the base 10 and in which the loops are then cut to produce a pile of a required height. The use of a tufting process allows the spacing and height of the pile to be any required spacing and height. It will be appreciated that, as in the FIG. 4 embodiment to be described below, the loops of the yarn of lower coefficient of friction need not be cut; they could be left uncut to form a row of loops. This will have the advantage of reducing the frictional forces between the pile and a contacting surface because the loops, with their rounded ends, create lower frictional forces than cut yarn ends.

Alternatively, the second pile may be formed by a weaving process. For example, the yarns of lower coefficient of friction may be woven simultaneously with the first yarn. The first yarn is, in this case, a crimped yarn fed under maximum tension while the yarn of lower coefficient of friction is uncrimped and fed under minimum tension. When the yarns are cut, the tensioned crimped yarn retracts more than the uncrimped yarn to leave the first pile at a lower pile height than the second pile.

The spacing of the second tufts 11*b* along the row may be greater, the same or less than the spacing of the first tufts 11*a*. Preferably, the spacing is less.

The pile need not be formed by tufts 11*a*, 11*b* but may, alternatively, be formed by connecting individual yarns of their respective materials to a base, for example, by use of any adhesive or by clamping the yarns in a suitable base.

In addition, there may be fibres of more than two yarns forming pile on the base 10; three or more fibres may be used. Where there are yarns of two materials, it is not necessary that the lower coefficient of friction yarn extends in a single row along the centre of the pile, two or more parallel rows of such a yarn may be provided either adjacent one another or separated by a row or rows of the remaining yarn. The row or rows of lower coefficient of friction yarn need not be continuous along their lengths; the row or rows may be interrupted. The lower coefficient of friction yarn may alternatively be arranged in spaced rows or groups of rows which extend across the width of the base 10, the rows or groups of rows being separated by pile formed by the remaining fibres.

The fibres of the lower coefficient of friction material need not form a pile which is higher than the pile formed by the remaining fibres, the fibres of the lower coefficient of friction material may form a pile which is the same height as or lower than the pile of the remaining fibres.

Figure 4:
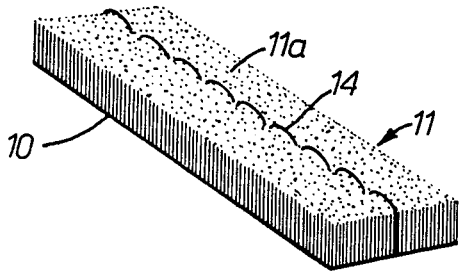
FIG. 4 is a perspective view of a second form of sealing strip.

In the embodiment of FIG. 4, the base 10 and the first tufts 11*a* are arranged and formed as the corresponding elements described above with reference to FIG. 1. The yarn of lower coefficient of friction does not, in this embodiment, form a pile, as in FIG. 1, but instead forms a series of stretches 14 of the material extending along the base 10 and on the surface of the first tufts 11*a*.

This embodiment can be used in the same applications as the embodiment of FIG. 1, operates in the same way and has the same advantages.

The embodiment of FIG. 4 may be manufactured as follows: the base 10 and the first tufts 11*a* are formed by a weaving or tufting process as described above with reference to FIG. 1. The lower coefficient of friction yarn, polytetrafluoroethylene yarn, for example, is then inserted into the first tufts 11*a* by a tufting process but the loops formed in the tufting process are left uncut so that stretches 14 of the material lie on or adjacent the surface of the first tufts 11*a*.

It will be appreciated that the length and interval between the stretches 14 may be varied as desired and that more than one row of such stretches may be provided. The stretches 14 need not be parallel to the longitudinal axis of the base 10 but may extend transversely of said axis, indeed the or some stretches 14 may be normal to said axis.

I claim:

1. A sealing strip for forming a seal between two adjacent surfaces which are relatively movable by manual operation and comprising an elongate strip-like base for attachment to one of said surfaces, parallel rows of pile formed by fibres of a polypropylene yarns extending from the base to contact the other of said surfaces, and a polytetrafluoroethylene yarn which has a lower coefficient of friction than the polypropylene yarn and which is carried on the strip-like base with the pile of fibres to contact the other of said surfaces whereby when the sealing strip is compressed between said surfaces, the polytetrafluoroethylene yarn reduces the frictional force tending to prevent relative movement between said pile and the surface contacted thereby in a direction parallel to the length of said base.

2. A strip according to claim 1, wherein the polytetrafluoroethylene yarn is in the form of an additional pile of fibres on the base.

3. A strip according to claim 2, wherein the yarns of both piles are arranged in parallel rows extending along the base and the polytetrafluoroethylene yarn forms at least a part of at least one row.

4. A strip according to claim 3, wherein the or each row of polytetrafluoroethylene yarn is between two rows of the polypropylene yarn.

5. A strip according to claim 3, wherein the polytetrafluoroethylene yarn forms a continuous row extending along the base and between at least two rows of the polypropylene yarn.

6. A strip according to claim 3, wherein each row of both yarns is formed by a row of tufts of fibres.

7. A strip according to claim 6, wherein the tufts of the or each row of the polytetrafluoroethylene yarn have a greater spacing therebetween along the length of the row than the tufts of the polypropylene yarn.

8. A strip according to claim 2, wherein the pile of polytetrafluoroethylene yarn has a greater pile height than the pile formed by the polypropylene yarn.

9. A strip according to claim 1, wherein the polytetrafluoroethylene yarn is arranged to lay on the surface of the pile of the polypropylene yarn to form at least one continuous or substantially continuous line of such material extending along the base.

10. A strip according to claim 1, wherein the polytetrafluoroethylene yarn forms a series of end-to-end stretches extending parallel to the length of the base and on the surface of the pile.

11. A method of manufacturing a sealing strip as claimed in claim 1, the method comprising form parallel rows of pile of a polypropylene yarn on an elongate strip-like base for attachment to one of said surfaces and arranging a polytetrafluoroethylene yarn of a lower coefficient of friction that the polypropylene yarn on the elongate strip-like base with the pile of fibres, whereby the polytetrafluoroethylene yarn and the pile of the polypropylene yarn contact and are compressed by the other of said surfaces to form a seal between the two surfaces and to reduce the frictional forces tending to prevent relative movement between the pile and the surface contacted thereby in a direction parallel to the length of the base.

12. A method according to claim 11, wherein the polytetrafluoroethylene yarn is formed by fibres of said material extending from the base and forming a pile.

13. A method according to claim 12, and comprising forming both of the piles from rows of tufts extending along the base.

14. A method according to claim 13, wherein the formation of the tufts is by a weaving process.

15. A method according to claim 13, wherein the formation of the tufts is by a tufting process.

16. A method according to claim 13, wherein the methods comprises forming the polytetrafluoroethylene pile yarn by a tufting process and forming the polypropylene pile by a weaving process.

17. A method according to claim 16, wherein the weaving process is performed before the tufting process.

18. A method according to claim 16, wherein the weaving process comprises weaving the polypropylene yarn between two parallel but spaced woven warps and wefts forming respective bases and then cutting the polypropylene yarn between the base to procude two pile-bearing bases.

19. A method according to claim 11, wherein the polytetrafluoroethylene yarn is arranged on the surface of the pile to form a generally continuous line of yarn extending over the pile of the polypropylene yarn and along the base.

20. A method according to claim 19, wherein the polytetrafluoroethylene yarn is arranged with a series of end-to-end stretches of the yarn extending parallel to the length of the base and on the surface of the pile.

21. A method according to claim 20, wherein the stretches of the polytetrafluoroethylene yarn are formed by a tufting process with the yarn not being but after insertion into the base.

22. A sealing strip for providing an air barrier between two surfaces relatively movable by manual operation, the sealing strip comprising:

an elongate fabric base for attachment to one of said relatively movable surfaces, a polypropylene yarn applied to the fabric base by a tufting process to form parallel rows of yarn loops with the ends thereof remote from the fabric base contacting the other end of said relatively movable surfaces, and a polytetrafluoroethylene yarn applied to the fabric base by a tufting process to form yarn loops located within the polypropylene yarn and contacting the other of said relatively movable surfaces, the polytetrafluoroethylene yarn having a lower coefficient of friction that the polypropylene yarn to reduce the frictional forces tending to prevent relative movement between the sealing strip and the other of said relatively movable surfaces.

23. A method of manufacturing a sealing strip as claimed in claim 22, the method comprising:

apply a polypropylene yarn to an elongate fabric base by a tufting process to form a first plurality of loops in parallel rows on said base, the first yarn loops contacting the other of said relatively movable surfaces for forming an air barrier in a direction transverse to the length of the elongate fabric base.

applying a polytetrafluoroethylene yarn to said elongate fabric base by a tufting process to form a second plurality of loops on said base and contacting said other of said relatively movable surfaces, the polytetrafluoroethylene yarn having a lower coefficient of friction than said polypropylene yarn.

* * * * *